US008746219B2

(12) United States Patent
Anselmo

(10) Patent No.: US 8,746,219 B2
(45) Date of Patent: Jun. 10, 2014

(54) ARCHERY BOW IN-LINE CABLE GUARD AND METHODS

(75) Inventor: Dan'l Anselmo, Stansbury, UT (US)

(73) Assignee: Hoyt Archery, Inc., Salt Lake City, UT (US)

( * ) Notice: Subject to any disclaimer, the term of this patent is extended or adjusted under 35 U.S.C. 154(b) by 315 days.

(21) Appl. No.: 12/859,875

(22) Filed: Aug. 20, 2010

(65) Prior Publication Data

US 2012/0042861 A1 Feb. 23, 2012

(51) Int. Cl.
*F41B 5/14* (2006.01)
*F41B 5/10* (2006.01)

(52) U.S. Cl.
CPC .... *F41B 5/14* (2013.01); *F41B 5/10* (2013.01)
USPC ..... 124/25.6

(58) Field of Classification Search
CPC ..... F41B 5/14; F41B 5/1426; F41B 5/143
USPC ..... 124/25.6, 900
See application file for complete search history.

(56) References Cited

U.S. PATENT DOCUMENTS

| | | | | | |
|---|---|---|---|---|---|
| 4,207,858 | A * | 6/1980 | Blackstone | ..... | 124/25.6 |
| 4,903,678 | A * | 2/1990 | Walker | ..... | 124/90 |
| 5,415,149 | A * | 5/1995 | Derus et al. | ..... | 124/23.1 |
| 5,722,385 | A * | 3/1998 | Bunk | ..... | 124/86 |
| 5,983,880 | A | 11/1999 | Saunders | | |
| 6,722,354 | B1 | 4/2004 | Land | | |
| 2010/0083943 | A1 * | 4/2010 | Grace et al. | ..... | 124/25.6 |

* cited by examiner

*Primary Examiner* — Gene Kim
*Assistant Examiner* — Amir Klayman
(74) *Attorney, Agent, or Firm* — Holland & Hart

(57) ABSTRACT

An archery bow cable guard includes a base portion and first and second cable rollers. The base portion is configured to mount to a riser of an archery bow. The first and second cable rollers are mounted to the base portion and arranged to contact a cable of the archery bow. Each roller has an axis of rotation that is arranged perpendicular to a length dimension of the cable. The axis of rotation of the first and second cable rollers are spaced apart in a direction parallel to a longitudinal dimension of the archery bow cable guard.

21 Claims, 8 Drawing Sheets

ARCHERY BOW IN-LINE CABLE GUARD AND METHODS

TECHNICAL FIELD

The present disclosure is directed to archery bows and accessories for archery bows.

BACKGROUND

Compound archery bows include pulleys at the ends of the bow limbs. The pulleys carry cables along with a bowstring, which are rigged to allow the bowstring to be drawn to launch an arrow. Because the pulleys lie within the same approximate spatial plane as the bowstring, cables, and arrow, the arrow shaft will contact the cables during the arrow launching process, unless the cables are braced out of the path of the arrow. Deflection rods or cable guards have been used for years to brace the cables out of the arrow path. A typical cable guard extends from the bow riser and is laterally offset from the plane of the cables and bowstring.

Some cable guards simply utilize a rod (often with a bend) for deflecting the cables. A cable slide is often used in conjunction with these types of rod-type cable guards. However, the frictional contact of the cables with the rod or cable slide reduced the speed by which the bowstring launches the arrow, which reduces, in turn, the arrow speed.

Rollers have been used to further reduce such frictional forces. The rollers may be part of a guide or guard assembly that is mounted to the rod. The guide assembly includes a pair of rollers positioned within a guide or guard structure. The rollers have traditionally been arranged in a side-by-side manner, typically arranged coaxially. The side-by-side arrangement of the rollers may induce additional torque and frictional forces on the cable that may have adverse effects on performance of the archery bow.

These and other problems are avoided and numerous advantages are provided by the apparatuses and methods described herein.

SUMMARY

One aspect of the present disclosure relates to an archery bow cable guard that includes a base portion and first and second cable rollers. The base portion is configured to mount to a riser of an archery bow. The first and second cable rollers are mounted to the base portion and arranged to contact cable portions of the archery bow. Each roller has an axis of rotation that is arranged perpendicular to the cable portions. The axis of rotation of the first and second cable rollers are also spaced apart in a direction parallel to a longitudinal dimension of the archery bow cable guard.

The first and second cable rollers may be offset laterally relative to each other. The first and second cable rollers may be arranged with the axis of rotation of each roller being perpendicular to the longitudinal dimension of the archery bow cable guard. The cable guard may further include a guide member having first and second apertures sized to receive the first and second cable rollers, respectively. The first and second cable rollers may be laterally offset from a plane extending through the riser and a bowstring of the archery bow. The first and second cable rollers may have the same shape and size.

Another aspect of the present disclosure relates to an archery bow that includes a riser, a cable, and a cable guard. The riser includes a handle grip. Upper and lower limbs each includes a distal end and a proximal end connected to the riser.

A pulley is positioned at the distal end of each of the upper and lower limbs. The cable extends between the pulleys. The cable guard includes a support portion connected to the riser, first and second cable rollers, and a guide portion connected to the support portion. The guide portion includes a first opening sized to receive the first roller and a second opening sized to receive the second roller. The first and second cable rollers are spaced apart in a direction of arrow flight from the archery bow.

The support portion and the guide portion may be constructed as a single, unitary piece. A first portion of the cable may extend through the first opening and in contact with the first roller, and a second portion of the cable may extend through the second opening and in contact with the second roller. The support portion may have an elongate shape having first and second ends, wherein the first end is connected to the riser and the second end is supports the guide portion.

A further aspect of the present disclosure relates to an archery bow that includes a riser, limbs connected to opposing ends of the riser, a cable member extending between free ends of the limbs, a bowstring extending between free ends of the limbs, and a cable guard extending from the riser. The cable guard includes first and second cable rollers arranged in series in a direction of bowstring travel toward and away from the riser during use of the archery bow.

The first and second cable rollers may each have an axis of rotation that is arranged perpendicular to the bowstring. The axis of rotation of the first and second cable rollers may be spaced apart. The first and second cable rollers may have substantially the same size and substantially the same shape. The first and second cable rollers may be at least partially positioned within a common plane.

A still further aspect of the present disclosure relates to a method of positioning an archery bow cable. The method includes providing an archery bow having a riser, limbs extending from the riser, a cable extending between free ends of the limbs, a bowstring extending between free ends of the limbs, and a cable guard that includes first and second cable rollers. The method further includes connecting the cable guard to the riser with the first and second cable rollers being arranged at least partially in line with each other relative to a length dimension of the cable guard, contacting a first portion of the cable with the first roller to position the first portion of the cable relative to the riser, and contacting a second portion of the cable with the second roller to position the second portion of the cable relative to the riser.

The cable guard may further include a first opening sized to receive the first roller and a second opening sized to receive the second roller, and the method includes extending the first and second portions of the cable through the first and second openings, respectively. Contacting the first and second portions of the cable may include moving the first and second portions of the cable in a lateral direction relative to the bowstring. The first and second cable rollers may each have an axis of rotation that is arranged perpendicular to the bowstring.

The foregoing and other features, utilities, and advantages of the subject matter described herein will be apparent from the following more particular description of certain embodiments as illustrated in the accompanying drawings.

DRAWINGS

DETAILED DESCRIPTION

Figure 1:
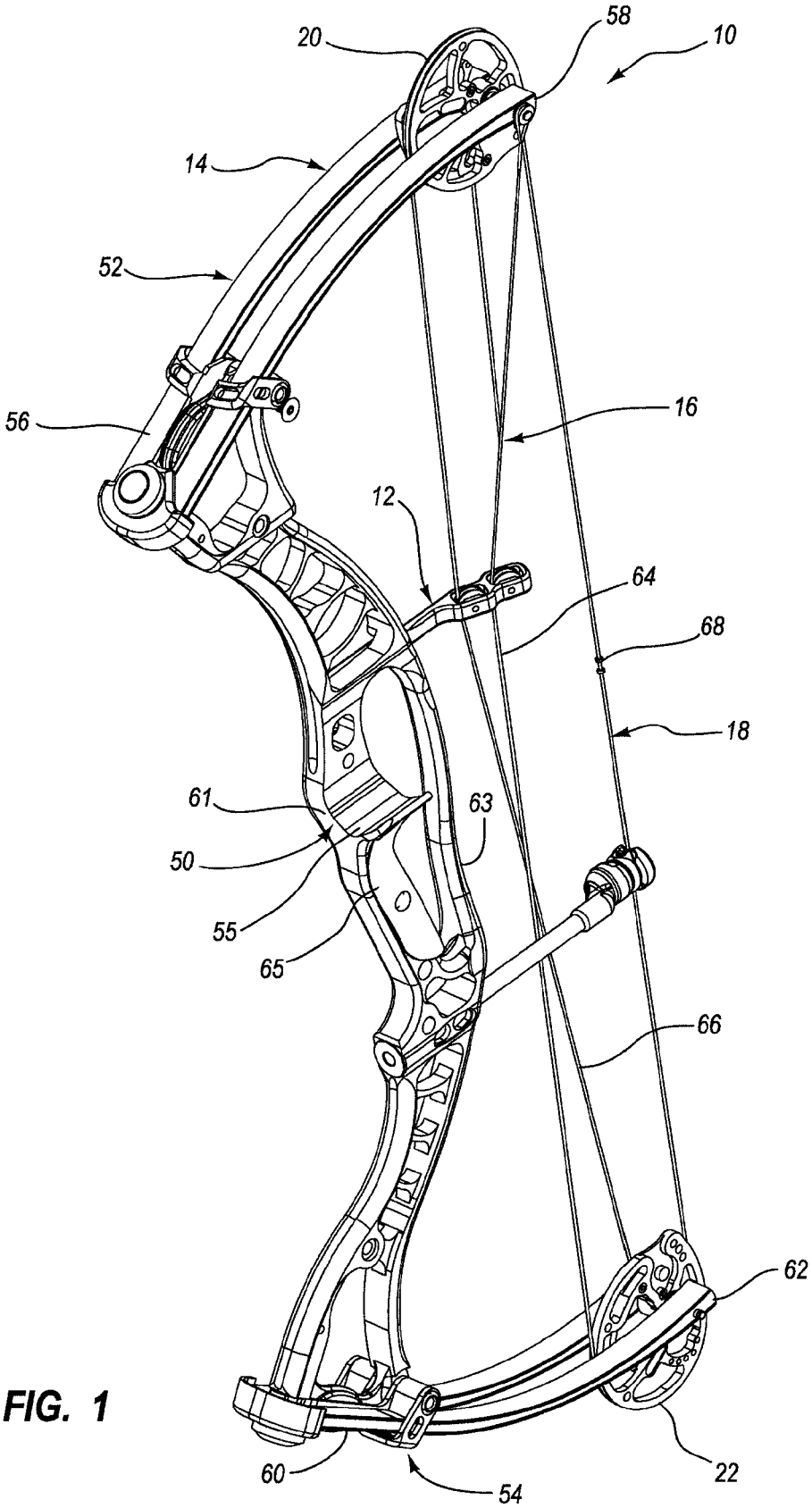
FIG. 1 is a perspective view of an example archery bow in accordance with the present disclosure.

Reference is made in the following to a number of illustrative embodiments of the subject matter described herein. The following embodiments illustrate only a few selected embodiments that may include the various features, characteristics, and advantages of the subject matter as presently described. Accordingly, the following embodiments should not be considered as being comprehensive of all of the possible embodiments. Also, features and characteristics of one embodiment may and should be interpreted to equally apply to other embodiments or be used in combination with any number of other features from the various embodiments to provide further additional embodiments, which may describe subject matter having a scope that varies (e.g., broader, etc.) from the particular embodiments explained below. Accordingly, any combination of any of the subject matter described herein is contemplated.

The present disclosure is directed to cable guards for use in an archery bow such as a compound archery bow. A compound archery bow typically includes a cable arrangement and a separate bowstring. The cable arrangement usually includes a pair of cable portions that criss-cross along their length extending between opposing ends of a handle riser assembly (sometimes referred to as a "bow") of the compound archery bow. The cables and bowstring are typically attached to pulley members that are mounted at the opposing ends of the handle riser assembly. The cable guard controls at least in part the cable portions of the cable arrangement while the compound bow is operated between undrawn and drawn positions to shoot an arrow.

The handle riser assembly has a length dimension measured between opposing ends of the handle riser assembly. The bowstring has a length dimension extending between the ends of the handle riser assembly. A nock point is typically mounted to the bowstring to provide a position indicator when positioning the arrow on the bowstring. The nock point may be moved in a generally perpendicular direction relative to the length dimension of the bowstring.

The arrow has a direction of motion or flight path when being shot from the compound bow that is also generally perpendicular to the length dimension of the handle riser assembly and bowstring, and generally parallel with the direction of nock point travel. The length dimension of the handle riser assembly, the bowstring, and the direction of movement of the nock point and the arrow are typically within a common plane (also referred to as a first plane).

The archery bow cable guard typically has a generally elongate construction. One end of the archery bow cable guard is mounted to the handle riser assembly, and an opposing end extends outward from the riser and toward the cables and bowstring. A length dimension of the archery bow cable guard measured between the opposing ends of the cable guard is typically arranged generally parallel with the direction of arrow flight and nock point travel.

The archery bow cable guard includes a pair of cable rollers. Each of the cable rollers rotates about a separate axis of rotation. The axis of rotation of the cable rollers is arranged generally perpendicular to the first plane. The axis of rotation of the cable rollers may also be defined as being generally perpendicular to the length dimension of the handle riser assembly, bowstring, and/or length dimension of the cable guard, and also generally perpendicular to the direction of nock point travel as the compound bow is operated between undrawn and drawn positions. The axis of rotation of the cable rollers may also be defined as being generally perpendicular to the direction of arrow flight as the arrow is launched from the compound bow. The axis of rotation of the cable rollers is spaced apart in the direction of nock point travel as the compound bow is operated between undrawn and drawn positions. The axis of rotation of the cable rollers may alternatively be defined as being offset from each other in a direction of arrow flight as the arrow is launched from the compound bow, or in a direction generally parallel with a length dimension of the cable guard. The cable rollers may also be defined as being oriented in series in a direction of arrow flight with an axis of rotation of the cable rollers being arranged generally perpendicular to the direction of arrow flight.

The orientation of the cable rollers of the archery bow cable guard may provide additional flexibility in the positioning of the archery bow cable guard along the length dimension of the handle riser assembly. Further, the orientation of the cable rollers may make it possible to orient the first and second cable portions of the cable arrangement as close to being in a common plane as possible along the length of the first and second cable portions without imposing additional friction forces at the intersection between the first and second cable portions. Other advantages of the example archery bow cable guards are discussed in further detail below.

Referring now to FIGS. 1-5, an example archery bow 10 is shown and described. The archery bow 10 includes an archery bow cable guard 12, a handle riser assembly 14, and a cable arrangement 16 and bowstring 18 extending between opposing free ends of the handle riser assembly 14. First and second pulleys 20, 22 are mounted at the opposing ends of the handle riser assembly 14. Portions of the cable arrangement 16 and bowstring 18 may be connected to the first and second pulleys 20, 22. The archery bow cable guard 12 may be mounted to the handle riser assembly 14 and arrange to contact portions of the cable arrangement 16. The archery bow cable guard 12 is described in further detail below with reference to FIGS. 6-9.

The handle riser assembly 14 includes a riser 50, an upper limb 52, and a lower limb 54. The riser 50 defines an arrow rest 55 which supports an arrow when shooting the arrow from the archery bow 10. The upper limb 52 includes proximal and distal ends 56, 58. The lower limb 54 includes proximal and distal ends 60, 62. The upper and lower limbs 52, 54 connect to the riser 50 at their proximal ends 56, 60, respectively. The first and second pulleys 20, 22 are mounted at the distal ends 58, 62 of the upper and lower limbs 52, 54, respectively. The archery bow cable guard 12 may be mounted to the handle riser assembly 14 at any desired position along the length of the riser 50. In at least one example, the archery bow cable guard 12 is mounted to the riser 50 at a location vertically above the arrow rest 55 at a location between the upper limb 52 and the arrow rest 55.

The archery bow cable guard 12 may be configured and arranged to mount to any surface or portion of the handle riser assembly 14. For example, the archery bow cable guard 12 may be mounted along a right side 57 of the riser 50 (see mounting arrangement shown in FIGS. 2 and 5), along a left side 59 (see FIG. 5), or along front or rear sides 61, 63 (see FIG. 1). In at least one example, the archery bow cable guard 12 is mounted to the handle riser assembly 14 and has a construction that provides movement of the cable arrangement 16 in a direction X (i.e., toward the right side 57) relative to the bowstring 18 to remove the cable arrangement 16 out of the path of arrow flight (see FIG. 5). In some examples, the archery bow cable guard 12 is mounted to one of the limbs 52, 54.

The cable arrangement 16 includes first and second portions 64, 66 that extend between the distal ends 58, 62 of the handle riser assembly 14. The cable arrangement 16 may be a continuous, single strand of cable. In other examples, the cable arrangement 16 may include multiple lengths of cable that are connected together. Typically, the first and second cable portions 64, 66 physically cross each other along their length extending between the distal ends 58, 62 of the handle riser assembly 14 (e.g., see FIGS. 1-3).

The bowstring 18 also extends between the distal ends 58, 62. At least portions of the bowstring 18 may be coupled to the first and second pulleys 20, 22. The bowstring 18 may have a nock point 68 secured thereon at any desirable location along the length of the bowstring 18. The nock 68 may define at least in part a location or position stop where an arrow is secured to the bowstring 18 during operation of the archery bow 10. When operating the archery bow 10, a user typically pulls the bowstring 18 in the direction Y (see FIG. 3) with one hand while holding the handle riser assembly stationary by grasping the riser 50 at a handle portion 65 with the other hand.

Figure 3:
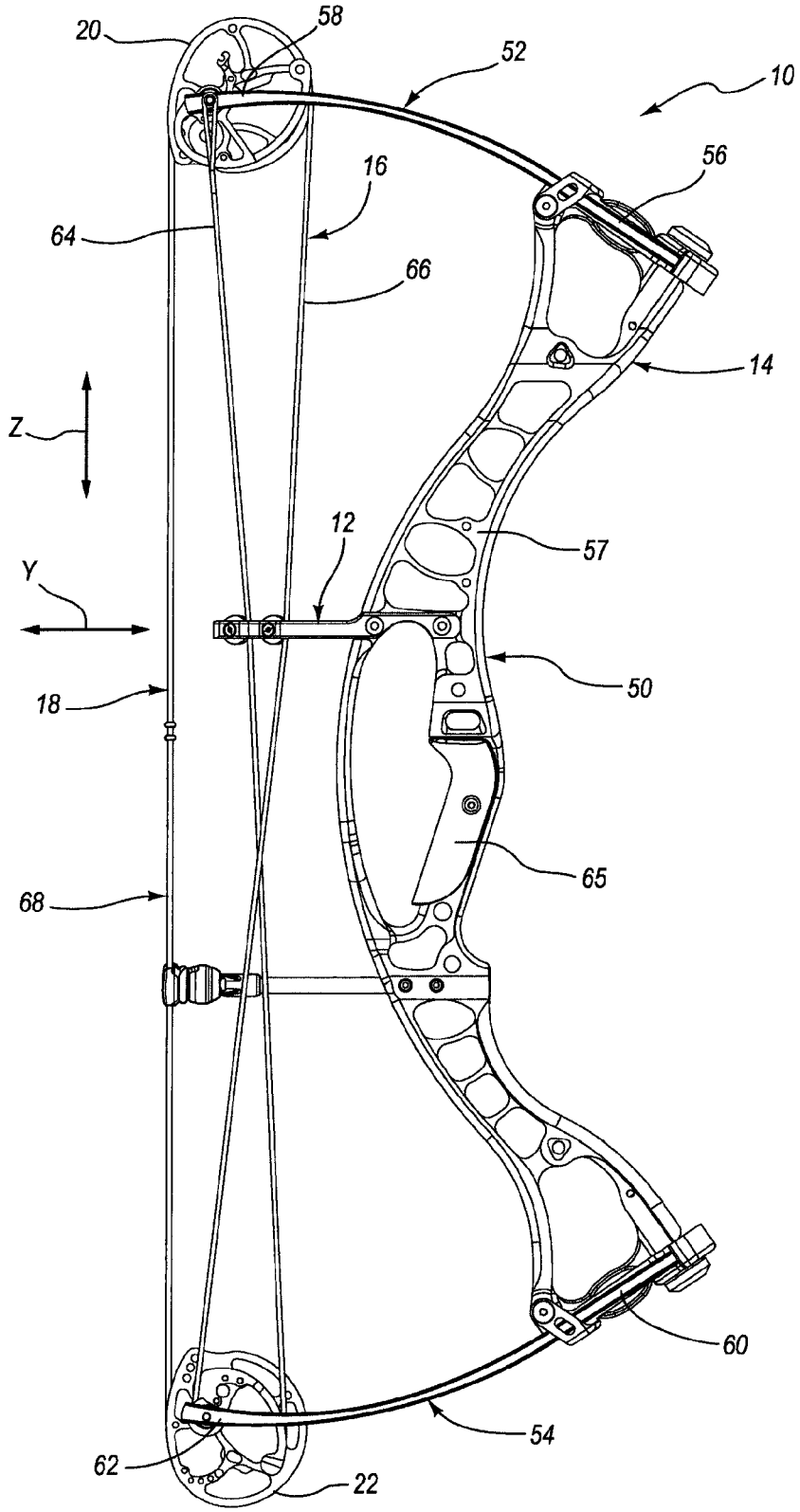
FIG. 3 is a side view of the archery bow shown in FIG. 1.
Figure 4:
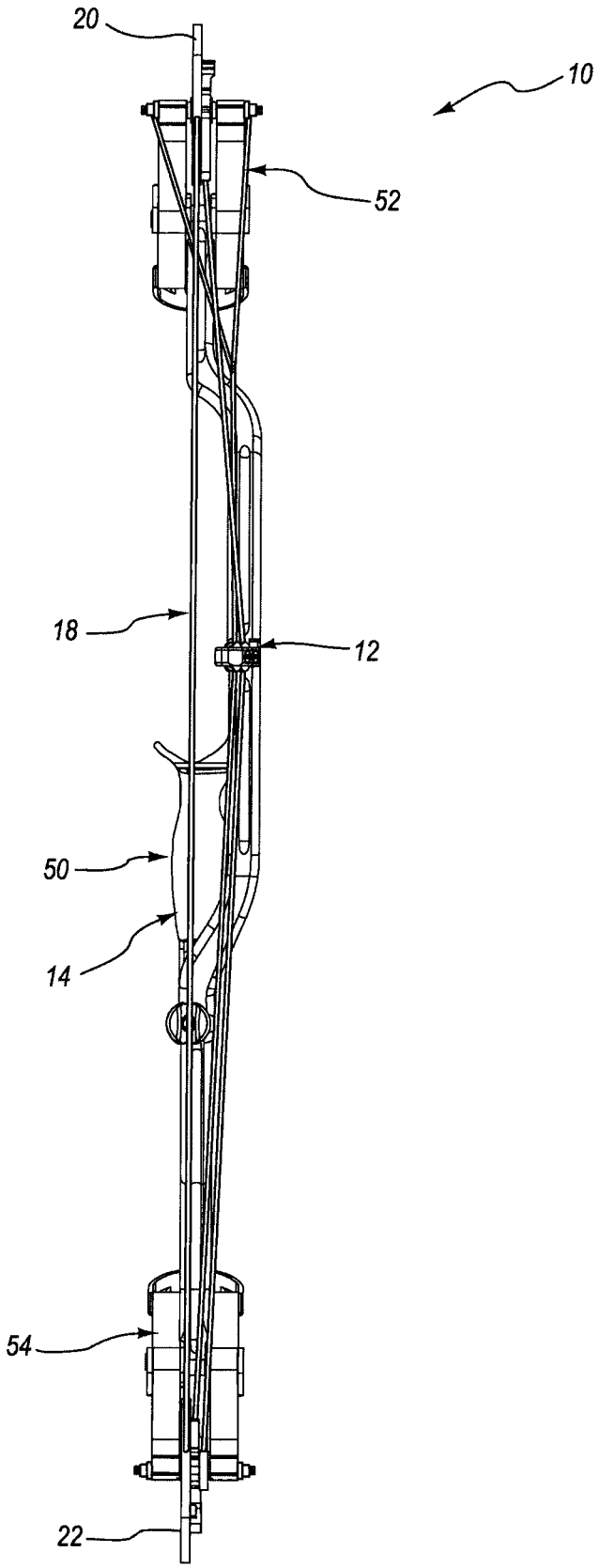
FIG. 4 is a rear view of the archery bow shown in FIG. 1.
Figure 5:
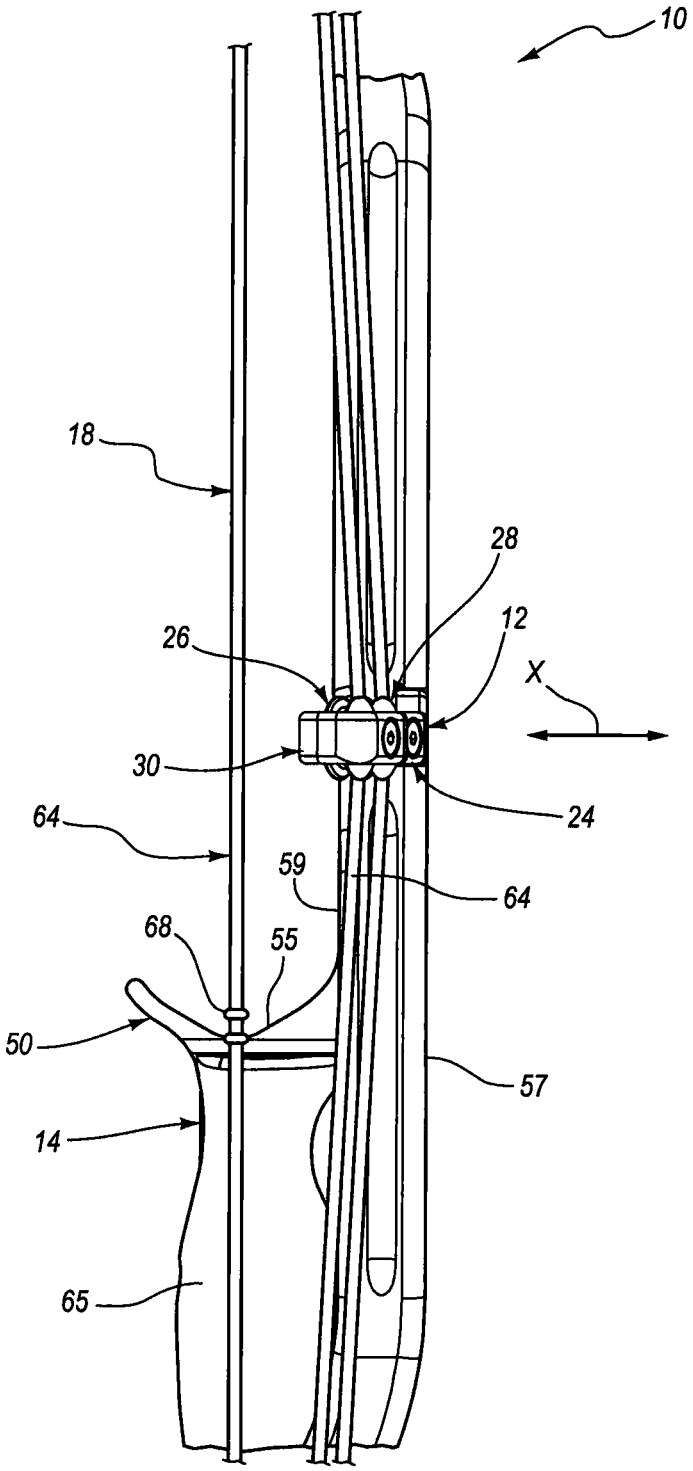
FIG. 5 is a partial close-up view of the archery bow shown in FIG. 4.
Figure 6:
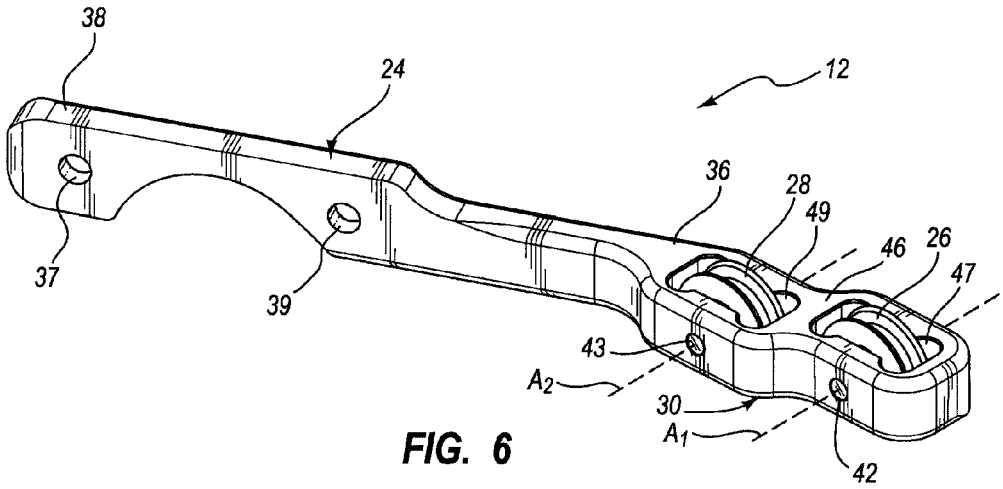
FIG. 6 is a top perspective view of an archery bow cable guard of the archery bow shown in FIG. 1.

A length dimension of the bowstring 18 extends in the Z direction (see FIG. 3). A length dimension of the handle riser assembly 14 is measured in the Z direction. A length dimension of the handle riser assembly 14 may alternatively be defined by a distance between the distal ends 58, 62. Alternatively, a length dimension of the handle riser assembly 14 is defined extending from the distal end 58 of the upper limb, along with the length of the upper limb, along the length of the riser 50, and along the length of the lower limb 54 to the distal end 62.

Referring now to FIGS. 6-10, the archery bow cable guard 12 is described in further detail. The archery bow cable guard 12 (also referred to as a cable guide) includes a base portion 24, first and second cable rollers 26, 28 each mounted at fixed locations on the base portion 24, a guide portion 30, first and second axles 34, 35, and first and second bushings 74, 75. The archery bow cable guard has a total length $L_1$ (see FIG. 7).

The base portion 24 includes distal and proximal ends 36, 38. The base portion 24 may have a length $L_2$ (see FIG. 7). The base portion 24 may include first and second mounting apertures 37, 39 (see FIG. 6) that receive fasteners or other mounting devices to secure the cable guard 12 to the handle riser assembly 14.

The first and second cable rollers 26, 28 each include an axle aperture 40, a cable receiving surface 41, and a bushing aperture 43. The first and second cable rollers 26, 28 may have a diameter $D_1$, $D_2$, a width $W_1$, $W_2$, and a rotation axis $A_1$, $A_2$, respectively (see FIGS. 6 and 10). The cable surface 41 may be sized to receive at least a portion of the cable arrangement 16. The cable surface 41 may be sized and constructed to provide a guiding or retaining function to support at least a portion of the cable arrangement 16 for moving in a side-to-side direction (e.g., along axis $A_1$ across width $W_1$). The axle aperture 40 is sized to receive at least a portion of the first or second axle 34, 35. The bushing aperture 43 is sized to receive at least a portion of the first or second bushing 74, 75.

The dimensions $D_1$, $D_2$ are typically in the range of about 5 mm to about 25 mm, and more preferably in the range of about 12 mm to about 19 mm. The widths $W_1$, $W_2$ are typically in the range of about 2 mm to about 8 mm, and more preferably in the range of about 3 mm to about 6 mm.

The first and second cable rollers 26, 28 may be identical in size and shape. Alternatively, at least one of the first and second cable rollers 26, 28 has a dimension (e.g., a diameter or width) that is different than the other of the cable rollers 26, 28. Further, the axle aperture 40, cable surface 41, and bushing aperture 43 may have different sizes or shapes for each of the rollers 26, 28.

The guide portion 30 is positioned at the distal end 36 of the base portion 24. In some arrangements, the guide portion 30 is formed as a separate piece that is mounted to the base portion 24. In other arrangements, the guide portion 30 is integrally formed with the base portion 24 as a single piece.

The guide portion 30 may include first and second axle apertures 42, 43, first and second bushing apertures 44, 45, an upper surface 46, a lower surface 48, and a thickness T defined between the upper and lower surfaces 46, 48. The first and second axle apertures 42, 43 may define, for example, a threaded bore that threadably engages a threaded shaft of the first and second axles 34, 35. The first and second bushing apertures 44, 45 may be sized to receive at least a portion of the first and second bushings 74, 75.

Figure 2:
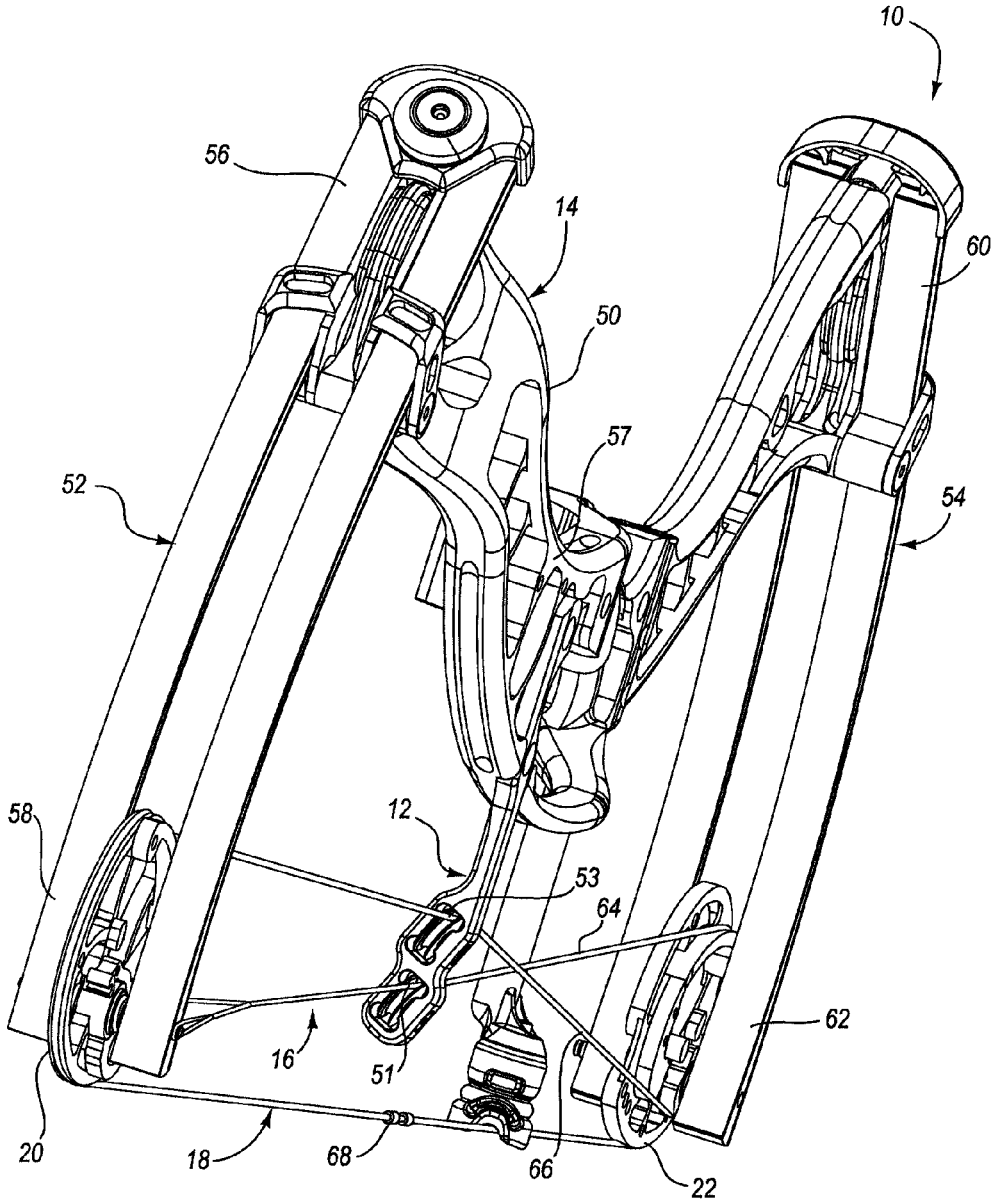
FIG. 2 is a top perspective view of the archery bow shown in FIG. 1.

The guide portion 30 may further include first and second roller apertures 47, 49 that are sized to receive at least portions of the first and second cable rollers 26, 28. When the first and second cable rollers 26, 28 are mounted within the first and second roller apertures 47, 49 of the guide portion 30 (i.e., see FIGS. 6-9) a space 51, 53 may be defined between end surfaces of the first and second roller apertures 47, 49 and the cable surfaces 41 of the first and second cable rollers 26, 28. The spaces 51, 53 permit passage of the first and second portions 64, 66 of the cable arrangement 16 through the archery bow cable guard 12. The cable spaces 51, 53 may be sized small enough that the cable is captured between the cable rollers 26, 28 and surfaces defined by the first and second roller apertures 47, 49, respectively, so that the archery bow cable guard 12 remains mounted to the cable rollers 26, 28. At least FIG. 2 illustrates the cable portions 64, 66 positioned within the cable spaces 51, 53, respectively. The first and second roller apertures 47, 49 may be separate and distinct apertures defined within the guide portion 30. In other arrangements, the first and second roller apertures 47, 49 may be continuous and open to each other.

The first and second axles 34, 35 may each include a head portion 70 and a axle or shaft portion 72. The shaft portion 72 may include a plurality of threads to assist in mounting the first and second axles 34, 35 to a threaded aperture of the guide portion 30. In some arrangements, the first and second axles 34, 35 are releasably mounted to the guide portion 30 with a threaded attachment. Other features may be used to mount the first and second axles 34, 35 to the guide portion 30. An example axle 34 is shown with reference to FIG. 10.

Figure 10:
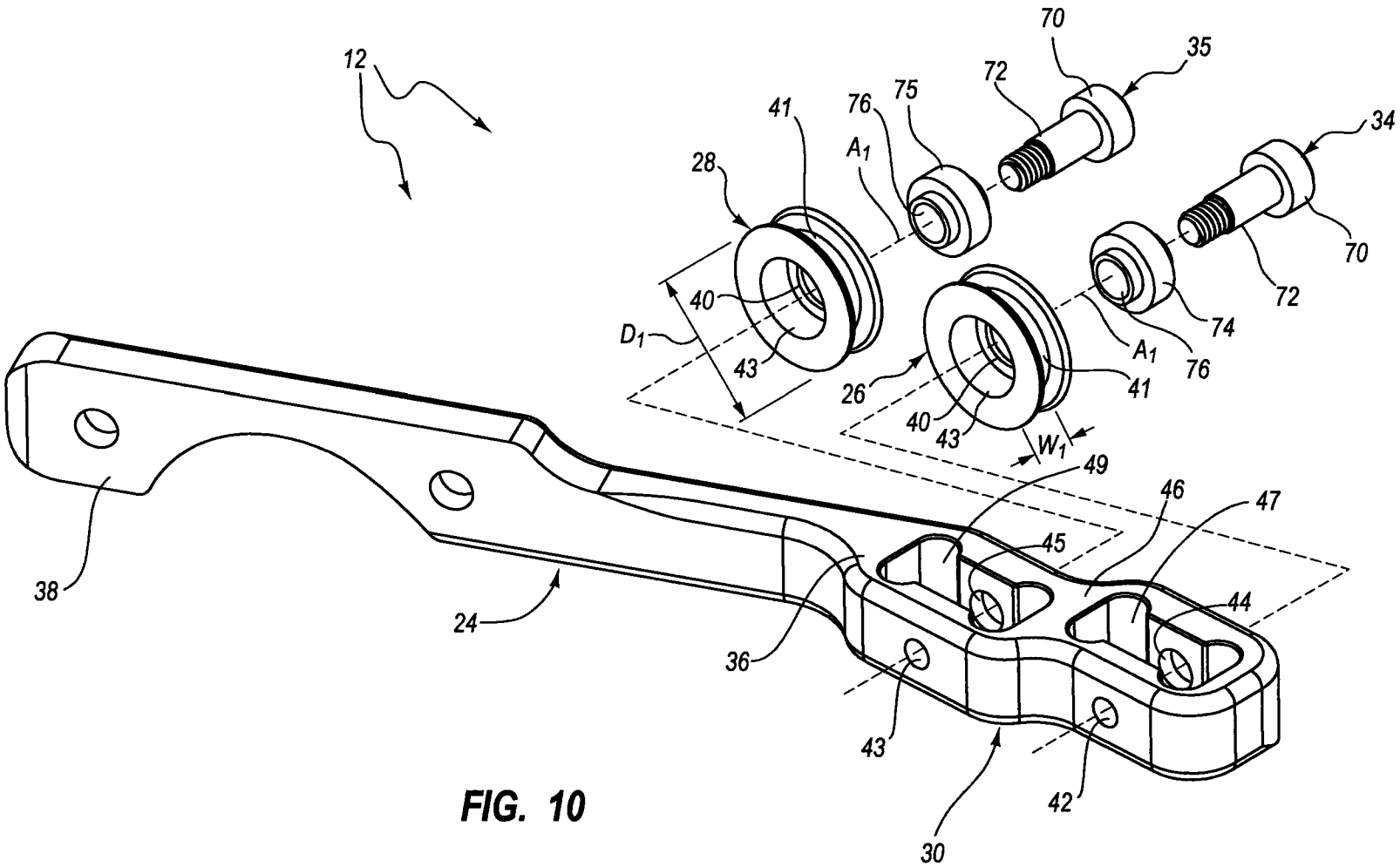
FIG. 10 is an exploded perspective view of the archery bow cable guard shown in FIG. 1.

Referring now to FIG. 10, a bushing 74 has an axle aperture 76. The second bushing 75 may have the same or similar features, size and structure as the first bushing 74. The bushings 74, 75 may define an interface between the first and second axles 34, 35 and the guide portion 30. The first and second bushing 74, 75 may also define an interface between the first and second cable rollers 26, 28 and the first and second axles 34, 35, respectively.

The first and second bushings 74, 75 may comprise a material that provides a low friction interface with the cable rollers 26, 28 and the axle 34, 35. In one example, the bushings 74, 75 include graphite or other lubricious material. Typically, the bushings 74, 75 comprise a polymeric material.

As discussed above, the archery bow cable guard 12 may be constructed and arranged when mounted to the handle riser assembly 14 to move the cable arrangement 16 out of a flight pathway of an arrow being shot from the archery bow 10. The archery bow cable guard 12 may laterally shift the cable arrangement 16 out of the arrow flight path and the direction of nock travel on the bowstring 18 during operation of the archery bow 10.

The axis of rotation of the cable rollers 26, 28 of the archery bow cable guard 12 may be arranged perpendicular to both a length dimension of the bowstring 18 and a direction of nock travel of the nock 68 on the bowstring 18 when operating the archery bow 10 between undrawn and drawn positions. The axis of rotation of the cable rollers 26, 28 may be arranged perpendicular to a common plane within which the length dimension of the bowstring 18 and length dimension of the handle riser assembly 14 reside. The axis of rotation of the cable rollers 26, 28 may also be arranged perpendicular to a length dimension of the handle riser assembly 14 as well as perpendicular to a direction of arrow travel when the arrow is shot from the archery bow 10. The axis of rotation of the cable rollers 26, 28 relative to the coordinates X, Y, Z shown in FIGS. 3 and 5 may be arranged generally in the X direction. The Y direction may be defined as the direction of arrow flight or nock travel. The Z direction may be defined by the length dimension of the bowstring 18 and/or length dimension of the handle riser assembly 14. In some embodiments, the axis of rotation of the rollers 26, 28 may be arranged at an angle between the X and Y directions and may be in the XY plane.

The first and second cable rollers 26, 28 may be offset at least partially in the Y direction (see FIG. 3). That is, the axis of rotation $A_1$, $A_2$ of the cable rollers 26, 28 are not coaxial, but rather are spaced apart in at least the Y direction. In other arrangements, the axis of rotation $A_1$, $A_2$ may be spaced apart in the Z direction as well.

Figure 7:
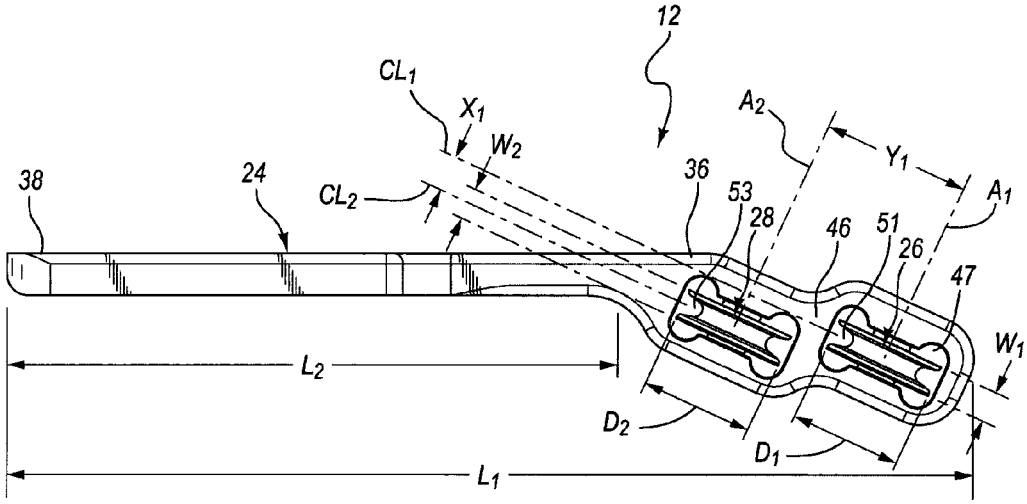
FIG. 7 is a top view of the archery bow cable guard shown in FIG. 6.
Figure 8:
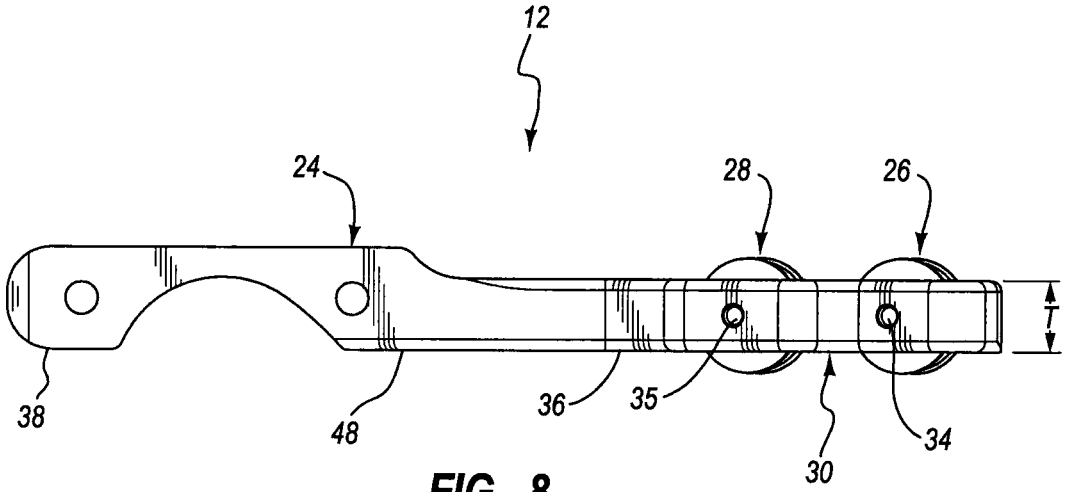
FIG. 8 is a first side view of the archery bow cable guard shown in FIG. 6.
Figure 9:
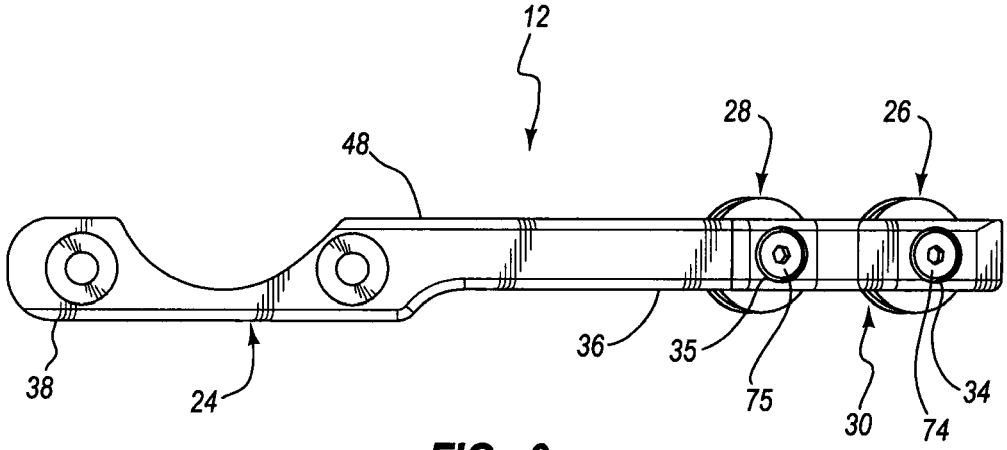
FIG. 9 is a second side view of the archery bow cable guard shown in FIG. 6.

Each of the cable rollers 26, 28 may include a centerline that divides the cable surface 41. The centerlines $CL_1$ and $CL_2$ are shown in FIG. 7. The centerlines $CL_1$ and $CL_2$ of the cable rollers 26, 28 may be spaced apart generally in the X direction. This spacing apart of the centerlines $CL_1$ and $CL_2$ may be defined as a lateral spacing or being spaced apart in a direction perpendicular to a plane within which the length dimension of the bowstring 18 and length dimension of the handle riser assembly 14 is defined.

The centerlines $CL_1$ and $CL_2$ may be spaced apart a distance $X_1$ (see FIG. 7), which defines the lateral offset of the first and second cable rollers 26, 28 from each other. The axis of rotation $A_1$, $A_2$ may be spaced apart a distance $Y_1$ (see FIG. 7). The distance $X_1$ may account at least in part for the lateral spacing apart of the first and second portions 64, 66 of the cable arrangement 16 where the cable portions 64, 66 cross. In the event that the distance $X_1$ is equal to zero, the archery bow cable guard 12 may imposing a force in the lateral distance X upon the first and second portions 64, 66 that that causes additional friction during operation of the archery bow 10. The further the archery bow cable guard 12 is spaced away from the crossing of the first and second cable portions 64, 66, the less friction is imposed on cable arrangement 16 by having $X_1$ approach zero.

The distance $Y_1$ may vary depending on a position of the archery bow cable guard 12 along the length of the riser 50. The further the archery bow cable guard 12 is positioned towards the upper limb 52 spaced away from the crossing point of the first and second portions 64, 66, the greater the distance $Y_1$. Likewise, the closer the archery bow cable guard 12 is positioned towards the crossing point of the first and second portions 64, 66, typically the smaller the distance $Y_1$.

The distance $Y_1$ may be in the range of about 1 mm to about 30 mm, and more preferably in the range of about 15 mm to about 25 mm. The distance $X_1$ is typically in the range of about 0.1 mm to about 8 mm, and more preferably in the range of about 4 to about 6 mm.

The guide portion 30 is shown and described as a single unitary piece to which both of the first and second cable rollers 26, 28 are mounted. In other arrangements, separate guide portions may be supported on a single base portion, wherein each guide portion mounts a single cable roller. In still further arrangements, multiple pairs of cable rollers may be included on a single archery bow cable guard. Each pair of cable rollers may be supported on a separate guide portion, and each guide portion is mounted to a single base portion. Other arrangements for mounting cable rollers to one or more base portions of an archery bow cable guard are possible. In each arrangement, typically the axis of rotation of each roller of a given pair of cable rollers are spaced apart in at least the Y direction (i.e., the direction of arrow flight or nock travel of the bowstring), and the axis of rotation is arranged perpendicular to both a length dimension of the bowstring and the direction of arrow flight.

It should be noted that for purposes of this disclosure, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in construction or, alternatively, may be removable or releasable in construction.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

As used herein, spatial or directional terms, such as "left," "right," "front," "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. An archery bow cable guard, comprising:

a base portion configured to mount to a riser of an archery bow;

first and second cable rollers mounted to the base portion and arranged to contact a cable of the archery bow, each roller remaining in a fixed position on the base portion and having an axis of rotation that is arranged perpendicular to the cable, each roller having a separate axis of rotation, the axis of rotation of the first cable roller and the axis of rotation of the second cable roller being offset laterally from each other.

2. The archery bow cable guard of claim 1 wherein the first and second cable rollers are offset laterally relative to each other.

3. The archery bow cable guard of claim 1 wherein the first and second cable rollers are arranged with the axis of rotation of each roller being perpendicular to the longitudinal dimension of the archery bow cable guard.

4. The archery bow cable guard of claim 1 further comprising a guide member having first and second apertures sized to receive the first and second cable rollers, respectively.

5. The archery bow cable guard of claim 1 wherein the first and second cable rollers are laterally offset from a plane extending through the riser and a bowstring of the archery bow.

6. The archery bow cable guard of claim 1 wherein the first and second cable rollers have the same shape and size.

7. An archery bow, comprising:

a handle riser assembly including a riser, upper and lower limbs each including a proximal end connected to the riser and a distal end, and a pulley positioned at the distal end of each of the upper and lower limbs;

a cable extending between the pulleys;

a cable guard having only two rollers, comprising:

first and second cable rollers arranged to rotate on different axes of rotation;

a support portion having first and second ends, the first end being connected to the riser and the second end being opposite from the first end to provide a constant length from the riser, the second end having a first opening sized to receive the first roller to rotate within the first opening and a second opening sized to receive the second roller to rotate within the second opening, the first and second cable rollers being spaced apart laterally with respect to each other.

8. The archery bow of claim 7 wherein the support portion and the guide portion are constructed as a single, unitary piece.

9. The archery bow of claim 7 wherein a first portion of the cable extends through the first opening and in contact with the first roller, and a second portion of the cable extends through the second opening and in contact with the second roller.

10. The archery bow of claim 7 wherein the support portion is elongate shaped having first and second ends, the first end being connected to the riser and the second end supports the guide portion.

11. An archery bow comprising:

a riser;

limbs connected to the riser;

a cable member extending between free ends of the limbs;

a bowstring extending between free ends of the limbs;

a cable guard extending from the riser, the cable guard including first and second cable rollers, a first opening sized to receive the first roller, and a second opening sized to receive the second roller, the first and second rollers being spaced apart laterally with respect to each other, the first and second rollers being arranged non-coaxially and maintaining a fixed position relative to the riser during use of the archery bow.

12. The archery bow of claim 11, wherein the first and second cable rollers each have an axis of rotation that is arranged perpendicular to the bowstring.

13. The archery bow of claim 12, wherein the axis of rotation of the first and second cable rollers are spaced apart.

14. The archery bow of claim 11, wherein first and second cable rollers have substantially the same size and substantially the same shape.

15. The archery bow of claim 11, wherein the first and second cable rollers are at least partially positioned within a common plane.

16. The archery bow of claim 11, wherein the first and second cable rollers are arranged coplanar.

17. A method of positioning an archery bow cable, comprising:

providing an archery bow having a riser, limbs extending from the riser, a cable extending between free ends of the limbs, a bowstring extending between free ends of the limbs, and a cable guard, the cable guard including first and second cable rollers each being rotatably mounted at fixed positions relative to the riser during use of the archery bow, a first opening sized to receive the first roller, and a second opening sized to receive the second roller, the first roller and the second roller having different axes of rotation, the first roller and the second roller being laterally spaced apart;

contacting a first portion of the cable with the first roller to position the first portion of the cable relative to the riser;

contacting a second portion of the cable with the second roller to position the second portion of the cable relative to the riser.

18. The method of claim 17 wherein the cable guard further includes a first opening sized to receive the first roller, and a second opening sized to receive the second roller, the method including extending the first and second portions of the cable through the first and second openings, respectively.

19. The method of claim 17 wherein contacting the first and second portions of the cable includes moving the first and second portions of the cable in a lateral direction relative to the bowstring.

20. The method of claim 17 wherein the first and second cable rollers each have an axis of rotation that is arranged perpendicular to the bowstring.

21. The archery bow of claim 7 wherein the first and second cable rollers each include a rotation axis, the rotation axis of the first cable roller being laterally space apart from the rotation axis of the second cable roller.

* * * * *